US011161642B2

(12) United States Patent
Shilale et al.

(10) Patent No.: US 11,161,642 B2
(45) Date of Patent: Nov. 2, 2021

(54) FASTENER ASSEMBLY

(71) Applicant: Avery Dennison Retail Information Services, LLC, Westborough, MA (US)

(72) Inventors: Thomas Shilale, Douglas, MA (US); Charles Burout, Bedford, NH (US)

(73) Assignee: Avery Dennison Retail Information Services, LLC, Mentor, OH (US)

( * ) Notice: Subject to any disclaimer, the term of this patent is extended or adjusted under 35 U.S.C. 154(b) by 423 days.

(21) Appl. No.: 14/456,417

(22) Filed: Aug. 11, 2014

(65) Prior Publication Data

US 2016/0039555 A1 Feb. 11, 2016

(51) Int. Cl.

| | |
|---|---|
| ***B65C 7/00*** | (2006.01) |
| ***G09F 3/14*** | (2006.01) |
| ***A44B 99/00*** | (2010.01) |

(52) U.S. Cl.

CPC ..... *B65C 7/003* (2013.01); *A44B 99/00* (2013.01); *G09F 3/14* (2013.01)

(58) Field of Classification Search

CPC .. G09F 3/04; G09F 3/08; A46D 69/00; B35C 27/00; B35C 27/003

USPC ..... 227/67; 24/711.1

See application file for complete search history.

(56) References Cited

U.S. PATENT DOCUMENTS

| | | | |
|---|---|---|---|
| 1,415,330 | A | 5/1922 | Frankel |
| 1,701,240 | A | 2/1929 | Maclean |
| 2,908,908 | A | 10/1959 | Steinmetz et al. |
| 2,935,434 | A | 5/1960 | Dawson |
| 3,064,264 | A | 11/1962 | Spinney |
| 3,225,993 | A | 12/1965 | Hall |
| 3,402,435 | A | 9/1968 | Merser |
| 3,470,637 | A | 10/1969 | Daddona, Jr. |

(Continued)

FOREIGN PATENT DOCUMENTS

| | | |
|---|---|---|
| BE | 757335 | 4/1971 |
| CN | 2880736 | 3/2007 |

(Continued)

OTHER PUBLICATIONS

Texpac Inc., Automatic Tagging and Fastening Tools, Accessed Feb. 3, 2017 from: https://www.texpak.com/industrial-packaging-and-labeling-equipment/automatic-tagging-and-fastening-to-ols/.

(Continued)

*Primary Examiner* — Michelle Lopez

(57) ABSTRACT

A fastener assembly for coupling together two or more articles includes a plastic fastener and an anchoring member. The plastic fastener includes a pair of parallel cross-bars that are interconnected by a transverse filament. The anchoring member is constructed as a unitary, solid, plastic disc with opposing flattened surfaces. In use, the anchoring member is disposed against an outer surface of the articles to be coupled together. During the fastener dispensing process, the ejected cross-bar penetrates through the articles as well as the anchoring member. Upon completion, the ejected cross-bar lies directly upon the exposed surface of the anchoring member. As such, the stiffened anchoring member provides structural integrity to articles that are deformable in construction. In this manner, the anchoring member prevents intact removal of a dispensed fastener by either intentional or unintentional widening of the hole in the articles through which the fastener extends.

12 Claims, 4 Drawing Sheets

(56) References Cited

U.S. PATENT DOCUMENTS

| | | | | |
|---|---|---|---|---|
| 3,589,584 | A | 6/1971 | Ohlsson et al. | |
| 3,589,957 | A | 6/1971 | Maurice | |
| 3,650,451 | A | 3/1972 | Weiland et al. | |
| 3,650,452 | A | 3/1972 | Finke | |
| 3,744,495 | A | 7/1973 | Johnson | |
| 3,746,237 | A | 7/1973 | Nysten | |
| 3,755,934 | A | 9/1973 | Porcher et al. | |
| 3,765,110 | A * | 10/1973 | Olsen | G09F 3/14 24/711.1 |
| 3,794,550 | A | 2/1974 | Taillie | |
| 3,830,524 | A | 8/1974 | Abildgaard et al. | |
| 3,875,648 | A | 4/1975 | Bone | |
| 3,940,844 | A | 3/1976 | Colby et al. | |
| 3,985,067 | A | 10/1976 | Livio et al. | |
| 4,039,078 | A * | 8/1977 | Bone | B65C 7/003 206/343 |
| 4,111,347 | A | 9/1978 | Bone | |
| 4,189,049 | A * | 2/1980 | Silver | G09F 3/14 206/216 |
| 4,262,406 | A | 4/1981 | Fredrickson et al. | |
| 4,271,657 | A | 6/1981 | Lancaster, III et al. | |
| 4,275,672 | A | 6/1981 | Clad | |
| 4,300,326 | A | 11/1981 | Stackhouse | |
| 4,369,013 | A | 1/1983 | Abildgaard et al. | |
| 4,376,504 | A | 3/1983 | Birkhofer | |
| D273,177 | S | 3/1984 | Tcherneshoff | |
| 4,525,116 | A | 6/1985 | Holmberg | |
| 4,533,076 | A | 8/1985 | Bourque | |
| 4,580,815 | A | 4/1986 | Barber | |
| 4,589,583 | A | 5/1986 | Kunreuther et al. | |
| 4,596,349 | A | 6/1986 | Herten | |
| 4,684,050 | A | 8/1987 | Masas | |
| 4,718,158 | A | 1/1988 | Block | |
| 4,809,568 | A | 3/1989 | Decaro | |
| 5,020,713 | A | 6/1991 | Kunreuther | |
| 5,282,829 | A | 2/1994 | Hermes | |
| 5,321,872 | A * | 6/1994 | Merser | G09F 3/037 206/338 |
| 5,373,656 | A * | 12/1994 | Merser | G09F 3/14 206/807 |
| 5,476,204 | A | 12/1995 | Eisenpresser et al. | |
| 5,517,883 | A | 5/1996 | Goldi et al. | |
| 5,810,238 | A | 9/1998 | Kunreuther | |
| 5,924,620 | A | 7/1999 | Orikasa et al. | |
| 5,943,926 | A | 8/1999 | Habermehl | |
| 5,975,398 | A | 11/1999 | Evans | |
| 5,983,540 | A * | 11/1999 | Ashley | G09F 3/14 40/300 |
| 6,039,230 | A | 3/2000 | Yagi et al. | |
| 6,145,725 | A | 11/2000 | Omli | |
| 6,178,680 | B1 | 1/2001 | Sloot | |
| 6,536,648 | B2 | 3/2003 | Flannery et al. | |
| 6,561,406 | B1 | 5/2003 | Furutsu et al. | |
| 6,598,775 | B1 | 7/2003 | Chen | |
| 6,689,039 | B2 | 2/2004 | Kunreuther | |
| 6,779,700 | B2 | 8/2004 | Bruins et al. | |
| 6,908,022 | B2 | 6/2005 | Schmitz | |
| 6,981,983 | B1 | 1/2006 | Roseblatt et al. | |
| 7,036,680 | B1 | 5/2006 | Flannery | |
| 7,344,058 | B2 | 3/2008 | Bruins et al. | |
| 7,820,262 | B2 | 10/2010 | Dean et al. | |
| 8,413,866 | B2 | 4/2013 | Cooper et al. | |
| 8,657,172 | B2 | 2/2014 | Cooper | |
| 8,820,601 | B2 | 9/2014 | Gilbertson et al. | |
| 9,254,131 | B2 | 2/2016 | Soltz et al. | |
| 9,650,168 | B2 | 5/2017 | Takemoto et al. | |
| 2003/0006264 | A1 | 1/2003 | Flannery | |
| 2003/0102350 | A1 | 6/2003 | Liu et al. | |
| 2003/0127489 | A1 | 7/2003 | Flannery et al. | |
| 2005/0125958 | A1 | 6/2005 | Davignon et al. | |
| 2005/0150928 | A1 | 7/2005 | Kameyama et al. | |
| 2006/0289597 | A1 | 12/2006 | Bruins et al. | |
| 2010/0019014 | A1 | 1/2010 | Rodenhouse | |
| 2014/0165363 | A1 | 6/2014 | Cooper | |
| 2015/0351758 | A1 | 12/2015 | Shelton, IV et al. | |
| 2016/0039555 | A1 | 2/2016 | Shilale et al. | |
| 2018/0015767 | A1 | 1/2018 | Kim | |

FOREIGN PATENT DOCUMENTS

| | | |
|---|---|---|
| CN | 101563273 | 10/2009 |
| CN | 201334179 | 10/2009 |
| CN | 103946116 | 7/2014 |
| CN | 103999139 | 8/2014 |
| CN | 104080704 | 10/2014 |
| CN | 205891466 U | 1/2017 |
| EP | 0474938 | 3/1992 |
| EP | 0625317 | 11/1994 |
| EP | 2786364 | 6/2017 |
| GB | 2364092 | 1/2002 |
| JP | 2003-169731 | 6/2003 |
| JP | 3128727 | 1/2007 |
| TW | 201335029 | 9/2013 |

OTHER PUBLICATIONS

Avery Dennison Corporation, IndES Elastic Staple System, Accessed Feb. 3, 2017 from: http://pfs.averydennison.com/content/dam/averydennison/rbis/global/en/product-families/Fasteners/docs/IndES-Operator-Manual-rev-4-2014.pdf.

International Search Report and Written Opinion issued in corresponding IA No. PCT/US2014/072911, dated Jul. 20, 2015.

International Search Report and Written Opinion issued in corresponding IA No. PCT/US2017/027595 dated Jan. 22, 2018.

International Preliminary Report on Patentability issued in corresponding IA No. PCT/US2014/072911 dated Feb. 14, 2017.

International Preliminary Report on Patentability Opinion issued in corresponding IA No. PCT/US2017/027595 dated Oct. 24, 2019.

* cited by examiner

FASTENER ASSEMBLY

FIELD OF THE INVENTION

The present invention relates generally to the retail industry and more particularly to plastic fasteners used in the retail industry.

BACKGROUND OF THE INVENTION

Plastic fasteners are commonly utilized in the retail industry in a variety of different applications to couple together two or more separate items. For instance, plastic fasteners are often used to couple together (i) a pair of complementary articles of clothing, such as socks, gloves and the (ii) a merchandise tag, or ticket, to one or more articles of clothing (e.g., a merchandise ticket folded over the waistline of a pair of jeans), and (iii) a handheld item (e.g., a tool or toy) to its corresponding packaging (e.g., a screwdriver disposed against the front surface of a flat, cardboard display card).

In U.S. Pat. No. 4,039,078 to A. R. Bone, the disclosure of which is incorporated herein by reference, there are disclosed several different types of plastic fasteners. Each plastic fastener described in the patent is manufactured in a generally H-shaped configuration, with two shortened parallel cross-bars, or T-bars, being interconnected at their appropriate midpoints by a single, thin, flexible filament which extends orthogonally there between.

Plastic fasteners of the type described above are commonly fabricated as part of a continuously connected supply of fastener stock, which is also commonly referred to in the art simply as ladder stock due to its ladder-like appearance. Referring now to FIG. 1, there is shown a length of ladder stock that is presently manufactured and sold by Avery Dennison Corporation of Pasadena, Calif. under the PLASTIC STAPLE® and ELASTIC STAPLE™ lines of plastic fasteners. As can be seen, a length of ladder stock is shown that is preferably produced from one or more flexible plastic materials, such as nylon, polypropylene, polyurethane, polyester and the like, the ladder stock being identified generally by reference numeral 11. Ladder stock 11 comprises a pair of elongated and continuous side members, or rails, 13 and 15 which are interconnected by a plurality of equidistantly spaced cross-links 17.

An individual plastic fastener 18 is obtained from ladder stock 11 by severing side members 13 and 15 at the approximate midpoint between successive cross-links 17. As can be seen, each fastener 18 comprises a pair of cross-bars 19 and 21 which are interconnected by a thin, flexible filament 23, with cross-bars 19 and 21 comprising sections of side members 13 and 15, respectively, and filament 23 comprising a cross-link 17.

Automated plastic fastener dispensing devices, or machines, are well known in the art and are commonly used to dispense individual plastic fasteners from a reel of ladder-type fastener stock. For example, in U.S. Pat. No. 8,413,866 to W. J. Cooper et al., the disclosure of which is incorporated herein by reference, there is disclosed one well known type of plastic fastener dispensing device that is presently manufactured and sold by Avery Dennison Corporation of Pasadena, Calif. as the ST9500® fastener system.

In use, a fastener dispensing device of the type as described above can be used in the following manner, inter alia, to secure an item to its corresponding packaging. Specifically, with the item disposed against the packaging, a pair of parallel, hollow needles on the fastener dispensing device is linearly driven through the packaging on opposite sides of the item (i.e., with the item positioned between the needles). A feed mechanism then advances each rail of the supply ladder stock into axial alignment behind the longitudinal bore defined by a corresponding hollow needle. With each rail disposed as such, a severing mechanism severs each rail at the approximate midpoint between the two lowermost cross-links, thereby separating an individual fastener from the remainder of the ladder stock. Having separated an individual fastener from the ladder stock, an ejection mechanism ejects the cross-bars of the separated fastener through the bores of the pair of hollowed needles and, in turn, through the packaging previously penetrated by the needles.

During the fastener ejection process, each cross-bar is twisted into a substantially parallel relationship relative to the outer portions of the filament in order to allow for its penetration through the relatively small hole formed in the packaging by its corresponding needle, Once each cross-bar passes entirely through the hole in the packaging, the resilient construction of the plastic fastener causes each cross-bar to return to its original perpendicular orientation relative to the filament. Accordingly, upon completion of the fastener dispensing process, the inner surface of each generally cylindrical cross-bar lies flat against one surface of the packaging along a generally linear region of contact. At the same time, the majority of the stretchable filament extends tightly across the item on the opposite side of the packaging, thereby retaining the item to the packaging in a relatively secure fashion.

Referring now to FIGS. 2(*a*) and 2(*b*), there is shown one cross-bar 19 of a dispensed plastic fastener 18 that is lying flat against one surface 254 of a relatively flat packaging 25. Disposed as such, filament 23 fittingly projects through the relatively small circular hole 27 formed in packaging 25 by a corresponding fastener dispensing needle and, in turn, extends firmly across a designated item-for-sale (not shown) that is disposed against the opposite surface 25-2 of packaging 25. In this capacity, the taut filament 23 firmly secures the item to packaging 25.

In the retail industry, packaging 25 is commonly manufactured using a thick paper-based material, such as paperboard, chipboard, cardboard or the like. Due to its paper-based construction, packaging 25 is not particularly durable in nature. Rather, it has been found that paper-based packaging 25 can be easily torn or otherwise deformed by fastener 18, in an intentional or unintentional manner, through either (i) the application of torque on the item secured to packaging 25 or (ii) the twisting, pulling or other similar manipulation of plastic fastener 18 itself. In particular, the aforementioned actions often cause hole 27 in packaging 25 to substantially enlarge in cross-section.

If the width of hole 27 in packaging 25 is widened beyond the length of cross-bar 19, fastener 18 can be easily decoupled from packaging 25, thereby enabling the item-for-sale to be separated from packaging 25, which is highly undesirable, Otherwise, with hole 27 in packaging 25 slightly enlarged, as shown in FIG. 2(*c*), a significant force F can be applied to filament 23 which, in turn, causes cross-bar 19 to buckle at its approximate midpoint (i.e., such that the opposing ends 19-1 and 19-2 of cross-bar 19 bend, or pivot, away from packaging 25). Due to the generally Y-shape configuration formed at each end of fastener 18, the above-described condition is commonly referred to as "Y-ing" in the art. As can be appreciated, with each end of fastener 18 buckled into a narrow Y-shaped configuration, the damaged cross-bar 19 can be more easily pulled through the expanded hole 27 in the packaging 25, thereby enabling the item to be separated from its packaging.

SUMMARY OF THE INVENTION

It is an object of the present invention to provide a new and improved fastener assembly that is adapted to be coupled to at least one item.

It is another object of the present invention to provide a fastener assembly as described above that is designed to be fittingly inserted through a small needle-formed hole in the at least one item to which it is coupled.

It is yet another object of the present invention to provide a fastener assembly as described above that is difficult to remove intact from the at least one item to which it is coupled.

It is still another object of the present invention to provide a fastener assembly as described above that minimizes the effects of any intentional or unintentional widening of the small needle-formed hole in the at least one item to which it is coupled.

It is yet still another object of the present invention to provide a plastic fastener as described above that has a limited number of parts, is easy to use and is inexpensive to manufacture.

Accordingly, as one feature of the present invention, there is provided a fastener assembly adapted to be coupled to at least one article, the at least one article having a first surface, the fastener assembly comprising (a) a plastic fastener, the plastic fastener comprising a first cross-bar, and (b) a unitary, solid, anchoring member that is separate from the plastic fastener, the anchoring member being adapted to be disposed between the first cross-bar of the plastic fastener and the first surface of the at least one article.

As another feature of the present invention, there is provided a method of coupling a plastic fastener to at least one article using a fastener dispensing device, the fastener dispensing device having a hollow needle with a sharpened tip, the plastic fastener comprising a first cross-bar connected to a transverse filament, the at least one article having a first surface, the method comprising the steps of (a) providing a unitary, solid, anchoring member that includes a flat top surface and a flat bottom surface, (b) positioning bottom surface of the anchoring member against the first surface of the at least one article, (c) penetrating the anchoring member and the at least one article using the hollow needle of the fastener dispensing device, and (d) ejecting the first cross-bar through the hollow needle and out the sharpened tip so that the first cross-bar lies directly upon the top surface of the anchoring member.

Various other features and advantages will appear from the description to follow. In the description, reference is made to the accompanying drawings which form a part thereof, and in which is shown by way of illustration, an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts:

FIG. 2(*c*) is a fragmentary, right end perspective view of the fastener shown in FIG. 2(*a*), the fastener being shown with its cross-bar in a buckled state upon receiving a significant application of force on its filament, the hole in the article through which the filament extends being significantly expanded in cross-section;

DETAILED DESCRIPTION OF THE INVENTION

Figure 1:
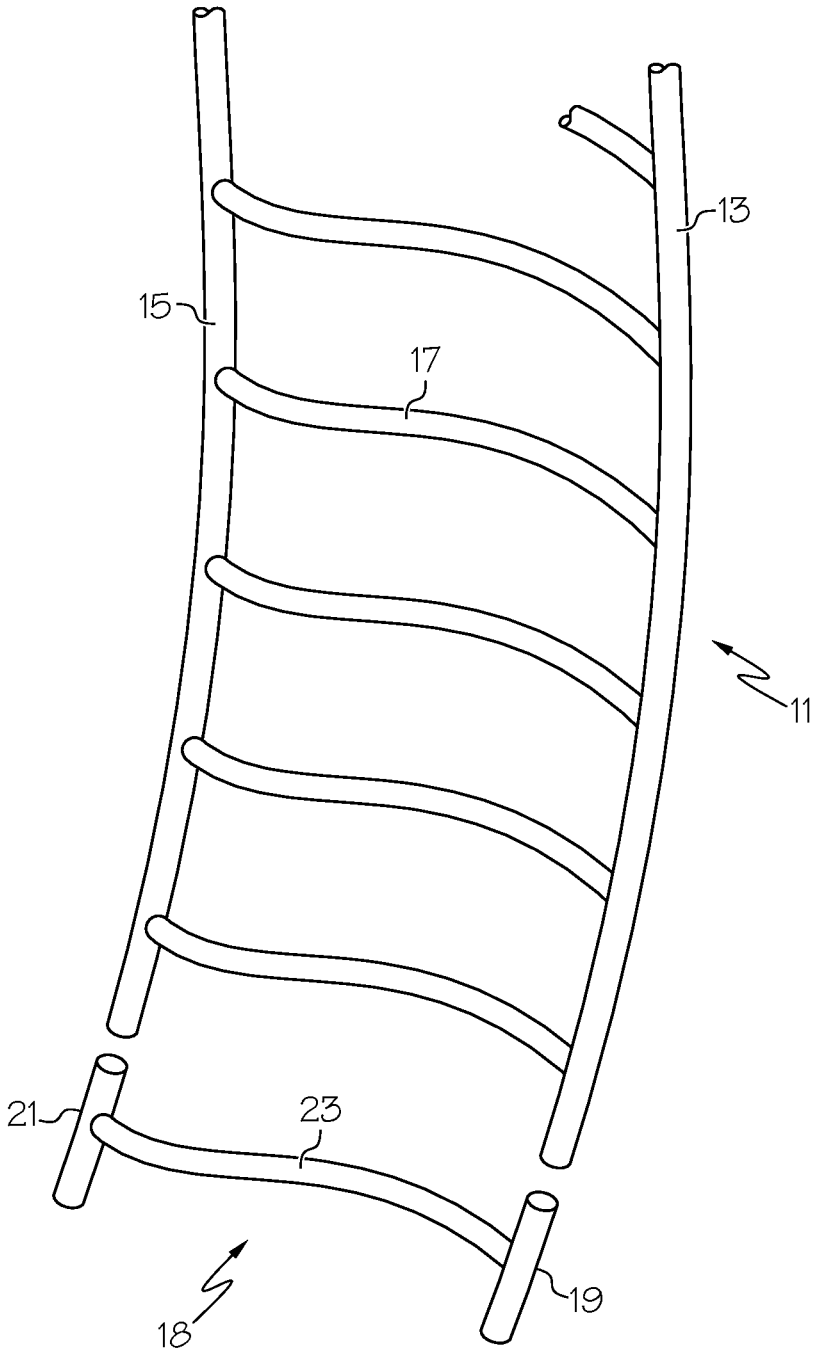
FIG. 1 (PRIOR ART)
FIG. 1 is a fragmentary, front perspective view of a length of continuously connected ladder stock that is known in the art, the ladder stock being shown with an individual plastic fastener separated therefrom.
Figure 2A:
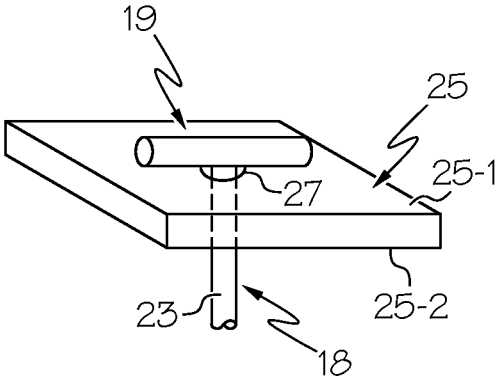
FIGS. 2(*a*) and 2(*b*) are fragmentary, right end perspective and right end plan views, respectively, of the fastener shown in FIG. 1, the fastener being shown secured to an article.
Figure 2B:
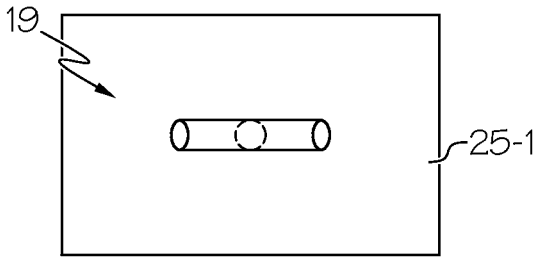
Figure 2C:
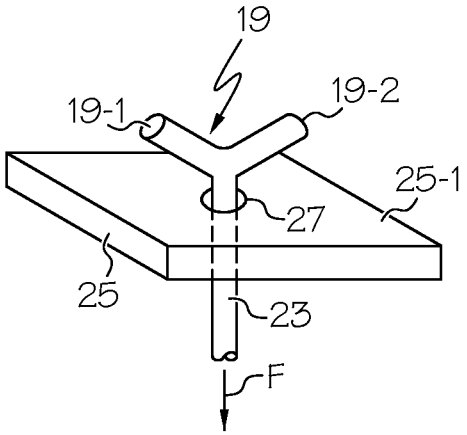
Figure 3:
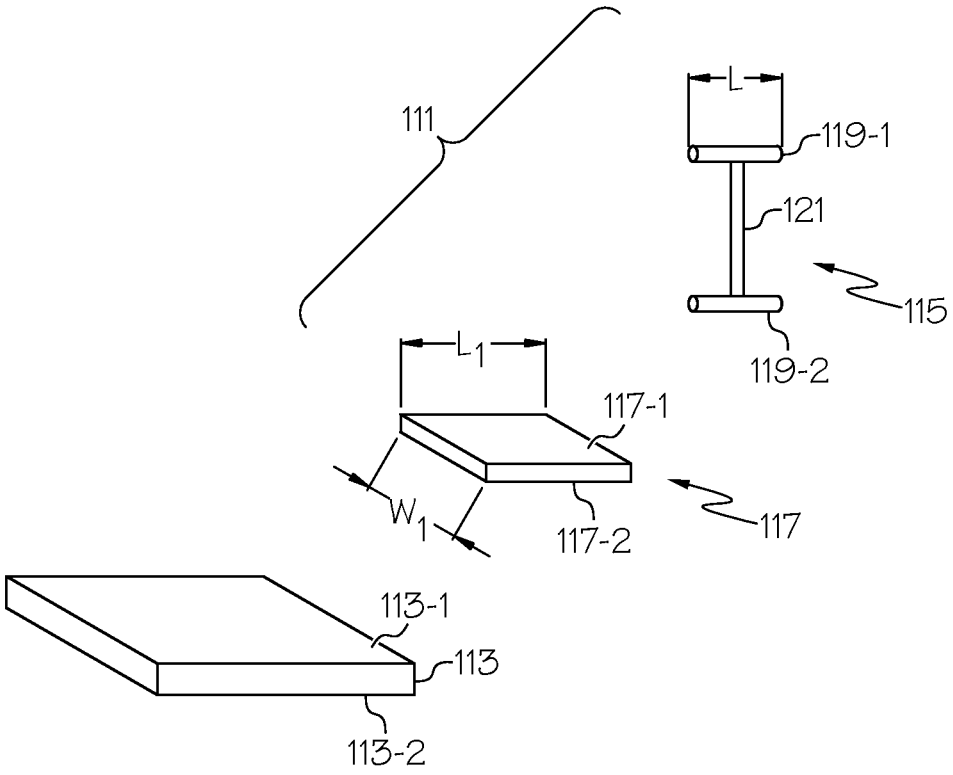
FIG. 3 is an exploded, right end perspective view of a fastener assembly constructed according to the teachings of the present invention, the fastener assembly being shown with an article.
Figure 4:
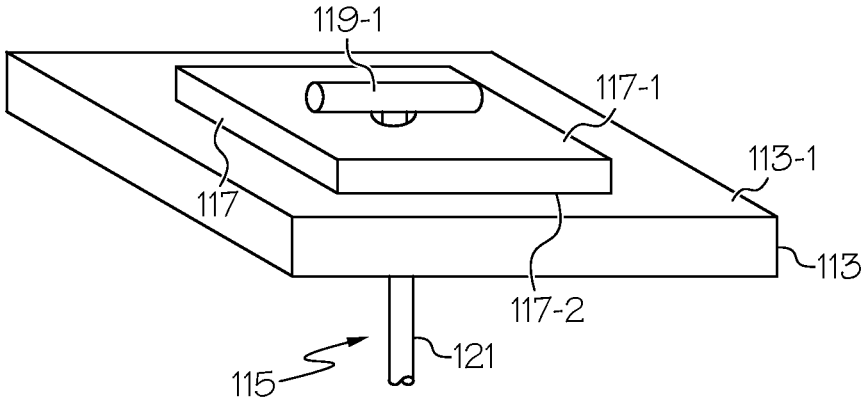
FIG. 4 is a right end perspective view of the fastener assembly shown in FIG. 3, the fastener assembly being shown coupled to the article.

Referring now to FIGS. 3 and 4, there is shown a fastener assembly constructed according to the teachings of the present invention, the fastener assembly being identified generally by reference numeral 111. As will be explained further below, fastener assembly 111 is designed to be coupled to one or more articles in a secure and reliable fashion.

For simplicity purposes only, fastener assembly 111 is shown herein and described in detail below as being secured to a single article 113. However, it is to be understood that fastener assembly 111 could be similarly coupled to two or more articles without departing from the spirit of the present invention.

In the present example, article 113 is represented as an enlarged, generally rectangular display card that includes a first, enlarged, generally flat surface 113-1 and a second, enlarged, generally flat surface 113-2, Because article 113 is represented herein as a display card, article 113 is preferably constructed out of a moderately rigid and durable packaging material that is well-suited for general retail applications. For instance, article 113 may be manufactured out of a plastic-based material or paper-based material, such as paperboard, chipboard, cardboard or the like. As will be described further in detail below, fastener assembly 111 is specifically designed to remain reliably secured to article 113 even if article 113 is slightly torn, ripped or otherwise deformed, which is a principal feature of the present invention.

It should be noted that article 113 is not limited to merchandise display cards or other similar forms of retail packaging, Rather, it is to be understood that article 113 represents any one or more items to which plastic fasteners are commonly coupled. For example, article 113 may alternatively represent, inter alia, (i) a pair of complementary articles of clothing, such as socks, gloves and the like, or (ii) a merchandise tag, or ticket, and one or more corresponding articles of clothing (e.g., a merchandise ticket folded over the waistline of a pair of jeans).

Fastener assembly 111 comprises a plastic fastener 115 and an anchoring member 117. As will be described in detail below, anchoring member 117 is disposed between article 113 and fastener 115 and is preferably constructed out of a stiff, polymer-based material, such as, but not limited to, polypropylene, polyethylene, polyethylene terephthalate, polyester, polyurethane and the like, so as to prevent intact withdrawal (i.e., the backing out) of plastic fastener 115 through the needle hole that is formed in article 113 during the fastener dispensing process.

Plastic fastener 115 is similar to individual plastic fastener 18 in that fastener 115 is preferably constructed from one or more flexible plastic materials, such as nylon, polypropylene, polyurethane or the like, and includes a pair of parallel cross-bars 119-1 and 119-2 that are interconnected by a thin, flexible transverse filament 121.

Each cross-bar 119 is represented herein as having a generally D shape in lateral cross-section and an overall length L which can range from 0.125 inches to 0.375 inches. Accordingly, fastener 115 could be readily obtained from prior art ladder stock 11 by severing side members 13 and 15 at the approximate midpoint between successive cross-links 17. In this manner, each cross-bar 119 is properly dimensioned for ejection through the corresponding hollow needle of a conventional fastener dispensing machine, which is highly desirable.

However, it should be noted that each cross-bar 119 is not limited to a particular size and/or shape. Rather, it is to be understood that each cross-bar 119 could be modified in its dimensions without departing from the spirit of the present invention. For instance, each cross-bar 119 could be generally D-shaped in transverse cross-section. Furthermore, the length L of each cross-bar 119 could be increased or decreased depending upon the retentive strength required of fastener 115 in its intended application.

Anchoring member 117 is preferably in the form of a unitary, solid disc, which is constructed out of a stiff plastic materials that resists deformation, such as, polypropylene, polyethylene, polyethylene terephthalate. As can be seen, anchoring member 117 is represented herein as a generally square-shaped tab that includes a flat top surface 117-1 and a flat bottom surface 117-2.

However, it should be noted that anchoring member 117 is not limited to a square-shaped design. Rather, it is to be understood that anchoring member 117 could be constructed in alternative configurations (e.g., as a circular disc) without departing from the spirit of the present invention. For instance, the anchoring member 117 may be rectangular, round, square etc.

The dimensions of anchoring member 117 preferably correspond to the dimensions of cross-bar 119 of plastic fastener 115. For example, in the present embodiment, anchoring member 117 preferably has a length $L_1$ of approximately 0.375 inches and a width $W_1$ of approximately 0.375 inches. Accordingly, because the length $L_1$ and width $W_1$ of anchoring member 117 are generally equal to the length L of cross-bar 119, but doesn't necessarily need to equal length L of the cross-bar, the entirety of cross-bar 119 is directly supported by anchoring member 117, and not by article 113, which is highly desirable for reasons to become apparent below. At the same time, anchoring member 117 remains at a reduced, nearly unperceivable size so as not to compromise the overall aesthetics of article 113.

Figure 5C:
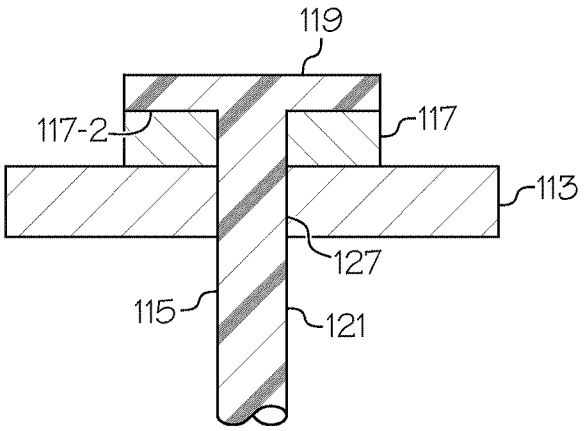
FIG. 5(*a*)-(*c*) are cross-section views of the fastener assembly shown in FIG. 3 at various stages during its coupling onto an article using a fastening dispensing device.
Figure 5A:
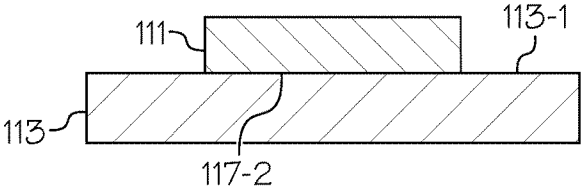
Figure 5B:
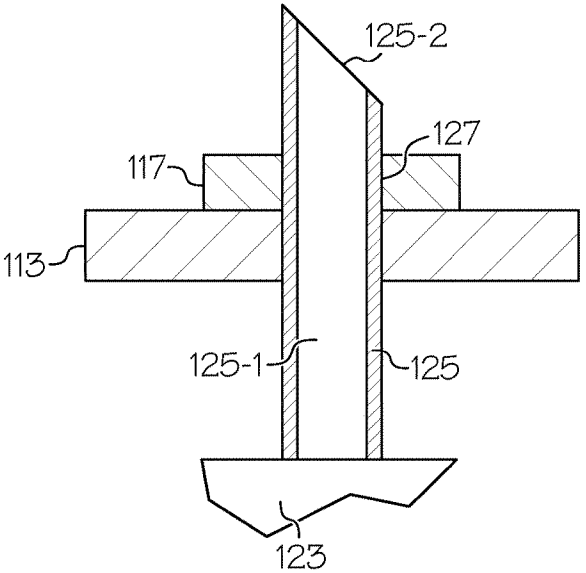

Referring now to FIGS. 5(*a*)-(*c*), fastener assembly 111 is designed to be coupled to article 113 in the following manner. Specifically, as shown in FIG. 5(*a*), solid anchoring member 117 is first disposed in place against article 113, with bottom surface 1174 of anchoring member 117 lying flat against first surface 113-1 of article 113. Preferably, anchoring member 117 is positioned on article 113 such that the needle of the fastener dispensing device will penetrate through the approximate center of anchoring member 117, as will be shown further below.

With anchoring member 117 positioned against article 113, fastener dispensing device 123 is activated such that hollow, slotted needle 125 penetrates through article 113 and anchoring member 117 in a centered fashion so as to create a continuous hole 127 therein, as shown in FIG. 5(*b*), One cross-bar 119 of fastener 115 is then axially displaced through the longitudinal bore 125-2 in needle 125 and subsequently ejected out through its sharpened tip 125-2. Thereafter, needle 125 is withdrawn from the continuous hole 127 formed in anchoring member 117 and article 113.

As seen most clearly in FIG. 5(*c*), the withdrawal of needle 125 results in cross-bar 119 lying flat against top surface 117-2 of anchoring member 117. At the same time, stretchable filament 121 is pulled tightly through hole 127 and extends tightly across second surface 113-2 of article 113 (and against any additional items positioned thereon).

As a principal feature of the present invention, it can be seen that rigid, non-deformable anchoring member 117 directly supports cross-bar 119 of fastener 115. As a result, even if the deformable, paper-based article 113 is ripped or torn so as to expand the cross-section of hole 127, fastener 115 cannot be removed intact from article 113 in any easy fashion. In this capacity, anchoring member 117 serves as a rigid plastic washer that helps preserve the structural integrity of article 113 (in particular, around hole 127) in an inconspicuous fashion.

The embodiment shown above is intended to be merely exemplary and those skilled in the art shall be able to make numerous variations and modifications to it without departing from the spirit of the present invention. All such variations and modifications are intended to be within the scope of the present invention as defined in the appended claims.

For example, although not shown herein, it is to be understood that anchoring member 117 could be constructed to include a preformed center bore that is dimensioned to fittingly receive a fastener dispensing needle. Accordingly, with the modified anchoring member properly positioned against an article, the needle 125 of fastener dispensing device 123 would preferably penetrate through the center bore. As a result, little to no additional insertion force would be required by the fastener dispensing device to penetrate through the anchoring member in addition to the articles to be fastened.

Figure 6:
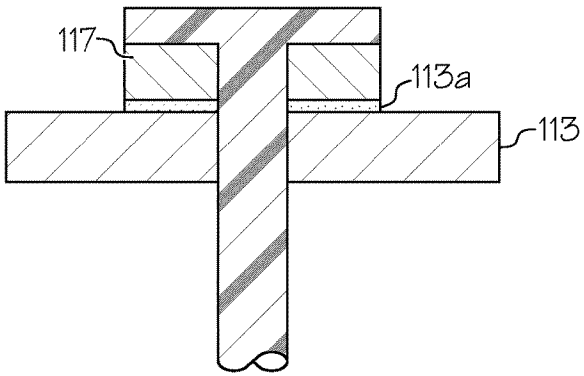
FIG. 6 is a cross-section view of the fastener assembly constructed according to the teachings of the present invention, in which the anchoring member is adhered to an article.

In another example, illustrated in FIG. 6, anchoring member 117 is in contact with article 113 via a pressure sensitive adhesive 13*a* on the anchoring member 117 surface. The adhesive would provide an adherence of member 117 to article 113.

What is claimed is:

1. A fastener assembly adapted to be coupled to at least one article, the at least one article having a first surface, the fastener assembly comprising:

(a) a plastic fastener, the plastic fastener comprising a first cross-bar; and (b) a unitary, solid, anchoring member made of rigid plastic that is separate from the plastic fastener and article, the anchoring member being adapted to be disposed between the first cross-bar of the plastic fastener and the first surface of the at least one article such that the anchoring member is in the form of a tab that includes a flat top surface and a flat bottom surface, wherein the dimensions of the anchoring member correspond to the dimensions of the cross-bar;

wherein the article is (i) a pair of complementary articles of clothing or (ii) a merchandise display card, a merchandise tag, or a ticket, and one or more corresponding articles of clothing.

2. The fastener assembly as claimed in claim 1 wherein the anchoring member is constructed of plastic.

3. The fastener assembly as claimed in claim 2 wherein the anchoring member is square, rectangular, or round.

4. The fastener assembly as claimed in claim 3 wherein the first cross-bar has a length of approximately 0.375 inches.

5. The fastener assembly as claimed in claim 4 wherein the anchoring member has a length of approximately 0.375 inches and a width of approximately 0.375 inches.

6. The fastener assembly as claimed in claim 5 wherein the plastic fastener further comprises:

(a) a second cross-bar extending in spaced apart, parallel relationship relative to the first cross-bar; and (b) a transverse filament that interconnects the first and second cross-bars.

7. The fastener assembly as claimed in claim 1, wherein the top surface of the anchoring member is exposed to an environment when the bottom surface is abutted against the article and the first cross-bar is abutted against the top surface of the anchoring member.

8. The fastener assembly as claimed in claim 1, wherein the length and width of the anchoring member are equal to the length of the cross-bar.

9. A method of coupling a plastic fastener to at least one article using a fastener dispensing device, the fastener dispensing device having a hollow needle with a sharpened tip, the plastic fastener comprising a first cross-bar connected to a transverse filament, the at least one article having a first surface, the method comprising the steps of:

(a) providing a unitary, solid, anchoring member made of rigid plastic that that is separate from the plastic fastener and article and includes a flat top surface and a flat bottom surface and the anchoring member is one of square, rectangular, or round, wherein the dimensions of the anchoring member correspond to the dimensions of the cross-bar;

(b) positioning the bottom surface of the anchoring member against the first surface of the at least one article;

(c) penetrating the anchoring member and the at least one article using the hollow needle of the fastener dispensing device; and (c) ejecting the first cross-bar through the hollow needle and out the sharpened tip so that the first cross-bar lies directly upon the top surface of the anchoring member;

wherein the article is (i) a pair of complementary articles of clothing or (ii) a merchandise display card, a merchandise tag, or a ticket, and one or more corresponding articles of clothing.

10. The method as claimed in claim 9 wherein the hollow needle penetrates through the approximate center of the anchoring member.

11. The method as claimed in claim 10 wherein the anchoring member is constructed of plastic.

12. The method as claimed in claim 9 wherein the anchoring member has a length of approximately 0.375 inches and a width of approximately 0.375 inches.

* * * * *